US009108307B2

(12) United States Patent
MacArthur

(10) Patent No.: US 9,108,307 B2
(45) Date of Patent: Aug. 18, 2015

(54) APPARATUS INCLUDING POWERED TOOL CONFIGURED TO FASTEN FASTENER TO ASSEMBLY

(75) Inventor: Benjamin MacArthur, Barrie (CA)

(73) Assignee: Honda Motor Co., Ltd., Tokyo (JP)

( * ) Notice: Subject to any disclaimer, the term of this patent is extended or adjusted under 35 U.S.C. 154(b) by 321 days.

(21) Appl. No.: 13/601,698

(22) Filed: Aug. 31, 2012

(65) Prior Publication Data

US 2014/0060254 A1 Mar. 6, 2014

(51) Int. Cl.
*B25B 21/00* (2006.01)
*B25B 23/14* (2006.01)

(52) U.S. Cl.
CPC ..... *B25B 21/00* (2013.01); *B25B 23/14* (2013.01)

(58) Field of Classification Search
CPC ..... B25B 21/00; B25B 21/002; B25B 23/14; B25B 23/142; B25B 23/145; B25B 23/147
USPC ..... 81/54, 57.24, 57.36, 57.4, 467, 451, 81/429
See application file for complete search history.

(56) References Cited

U.S. PATENT DOCUMENTS

| | | | | |
|---|---|---|---|---|
| 1,386,455 | A | 8/1921 | Clemens | |
| 1,970,179 | A | 8/1934 | Miller | |
| RE23,201 | E * | 2/1950 | Price | 81/451 |
| 3,779,663 | A * | 12/1973 | Ruggles | 408/113 |
| 4,155,278 | A | 5/1979 | Estok | |
| 4,179,955 | A | 12/1979 | Akiyoshi et al. | |
| 4,462,282 | A | 7/1984 | Biek | |
| 5,918,685 | A * | 7/1999 | Ulbrich et al. | 173/4 |
| 6,609,860 | B2 | 8/2003 | Wanek et al. | |
| 6,978,846 | B2 | 12/2005 | Kawai et al. | |
| 7,011,000 | B2 | 3/2006 | Kushida et al. | |
| 7,144,206 | B2 | 12/2006 | Burger et al. | |
| 2004/0146367 | A1 * | 7/2004 | Gerhardt et al. | 408/110 |
| 2010/0229691 | A1 | 9/2010 | Brändström et al. | |

FOREIGN PATENT DOCUMENTS

| | | | |
|---|---|---|---|
| DE | 3237325 | A1 | 4/1984 |
| DE | 3912991 | A1 | 10/1990 |
| JP | 9117869 | A | 5/1997 |
| JP | 2002192474 | A | 7/2002 |
| JP | 2004314252 | A | 11/2004 |

* cited by examiner

*Primary Examiner* — Hadi Shakeri
(74) *Attorney, Agent, or Firm* — Standley Law Group LLP

(57) ABSTRACT

An apparatus includes a powered tool configured to fasten a fastener to an assembly. The powered tool includes a fastener-driving assembly configured to selectively operatively engage the fastener. The fastener-driving assembly is also configured to selectively transmit a fastening force to the fastener. The powered tool also includes a fastener-engagement assembly configured to permit operative engageable access between the fastener-driving assembly and the fastener. For a case where the fastener-engagement assembly permits operative engageable access between the fastener-driving assembly and the fastener, the fastener-driving assembly may operatively engage the fastener, and the fastener-driving assembly may transmit the fastening force to the fastener.

19 Claims, 4 Drawing Sheets

APPARATUS INCLUDING POWERED TOOL CONFIGURED TO FASTEN FASTENER TO ASSEMBLY

TECHNICAL FIELD

Aspects of the invention generally relate to (but are not limited to) an apparatus including a powered tool configured to fasten a fastener to an assembly.

BACKGROUND

A powered tool is a tool that is actuated by an additional power source and mechanism other than the solely manual labor used with hand tools. The most common types of powered tools use electric motors. Internal combustion engines and compressed air are also commonly used. Other power sources include steam engines, direct burning of fuels and propellants or even natural power sources like wind or moving water. Powered tools are used in industry, in construction and/or manufacturing for purposes of, for example, driving fasteners, drilling, cutting, shaping, sanding, grinding, routing, polishing, painting, heating and more. Powered tools are classified as either stationary or portable, where portable means hand-held. Portable powered tools have advantages in mobility. Stationary power tools however often have advantages in speed and accuracy and some stationary powered tools can produce objects that cannot be made in any other way. A drill is a type of powered tool fitted with a cutting tool attachment or driving tool attachment, usually a drill bit or driver bit, used for drilling holes in various materials or for fastening various materials together with the use of fasteners.

A fastener is a hardware device that mechanically joins or affixes two or more objects together. A screw, or bolt, is a type of fastener characterized by a helical ridge, known as an external thread or just thread, wrapped around a cylinder. Some screw threads are designed to mate with a complementary thread, known as an internal thread, often in the form of a nut or an object that has the internal thread formed into it. Other screw threads are designed to cut a helical groove in a softer material as the screw is inserted. The most common uses of screws are to hold objects together and to position objects.

SUMMARY

During manufacturing of an assembly, the operator (also known as a manufacturing technician) may inadvertently use a known powered tool to incorrectly apply a fastening force (a tightening force) to the wrong fastener that should not receive the fastening force (the magnitude of the fastening force is not the required amount for instance), and so there is a possibility to undesirably manufacture many instances of incorrectly-manufactured assemblies.

The problem with known powered tools is that there is no control for which fasteners are to receive an appropriate fastening force so as to correctly tighten the fasteners, and which fasteners are not to receive an inappropriate fastening force.

Therefore, in order to mitigate (at least in part) the foregoing problem(s), an apparatus has been developed that includes a powered tool configured to fasten a fastener to an assembly. The powered tool includes a fastener-driving assembly configured to selectively operatively engage the fastener. The fastener-driving assembly is also configured to selectively transmit a fastening force to the fastener. The powered tool also includes a fastener-engagement assembly configured to permit operative engageable access between the fastener-driving assembly and the fastener. For a case where the fastener-engagement assembly permits operative engageable access between the fastener-driving assembly and the fastener, the fastener-driving assembly may operatively engage the fastener, and the fastener-driving assembly may transmit the fastening force to the fastener In addition, in order to mitigate (at least in part) the foregoing problem(s), a method of using an apparatus has been developed that includes a powered tool configured to fasten a fastener to an assembly. The method includes: (A) using a fastener-engagement assembly to permit operative engageable access between a fastener-driving assembly and the fastener, (B) in response to operative engageable access being permitted by the fastener-engagement assembly, using the fastener-driving assembly to operatively engage the fastener between the fastener-driving assembly and the fastener, and (C) using the fastener-driving assembly to transmit a fastening force to the fastener.

Other aspects and features of the non-limiting embodiments (examples) may now become apparent to those skilled in the art upon review of the following detailed description of the non-limiting embodiments with the accompanying drawings.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
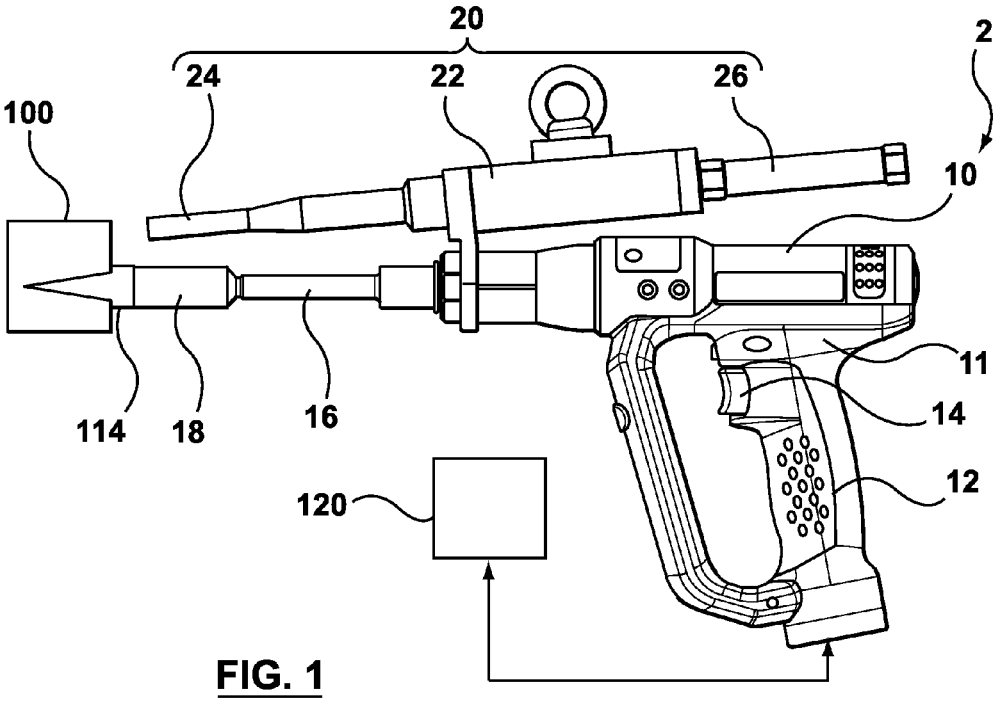
FIGS. 1, 2 and 3 depict schematic examples of side views of representations of an apparatus.

The drawings are not necessarily to scale and may be illustrated by phantom lines, diagrammatic representations and fragmentary views. In certain instances, details not necessary for an understanding of the embodiments (and/or details that render other details difficult to perceive) may have been omitted.

DETAILED DESCRIPTION OF EXEMPLARY EMBODIMENT(S)

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the examples as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments (examples) aspects and/or concepts defined in the appended claims. Hence, specific dimensions and other physical characteristics relating to the embodiments disclosed herein are not to be considered as limiting, unless the claims expressly state otherwise.

Figure 2:
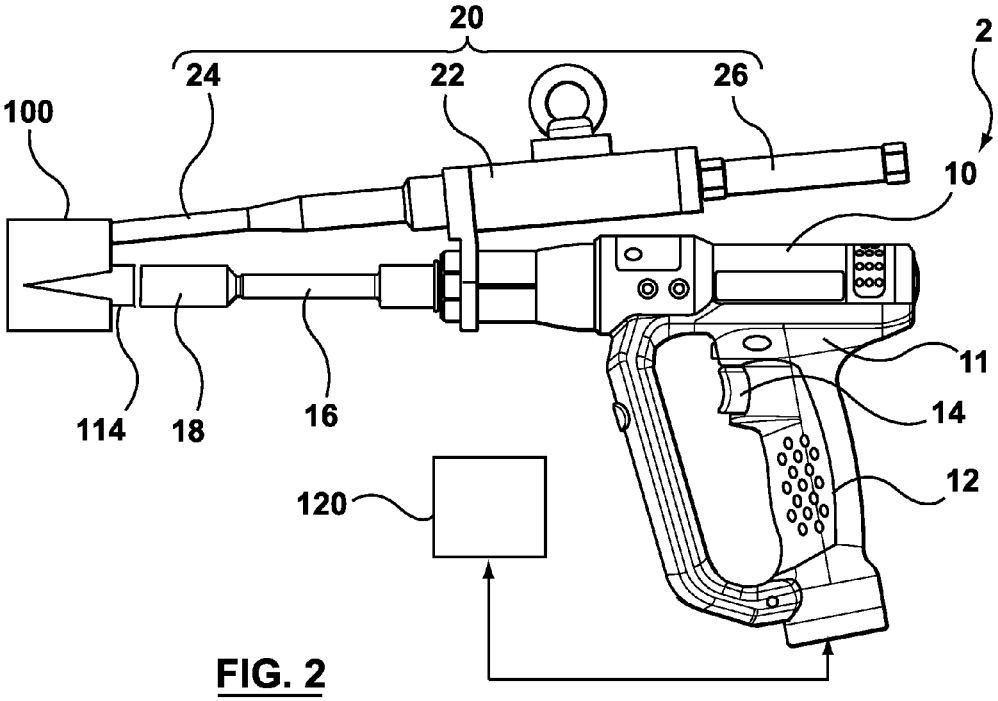
Figure 3:
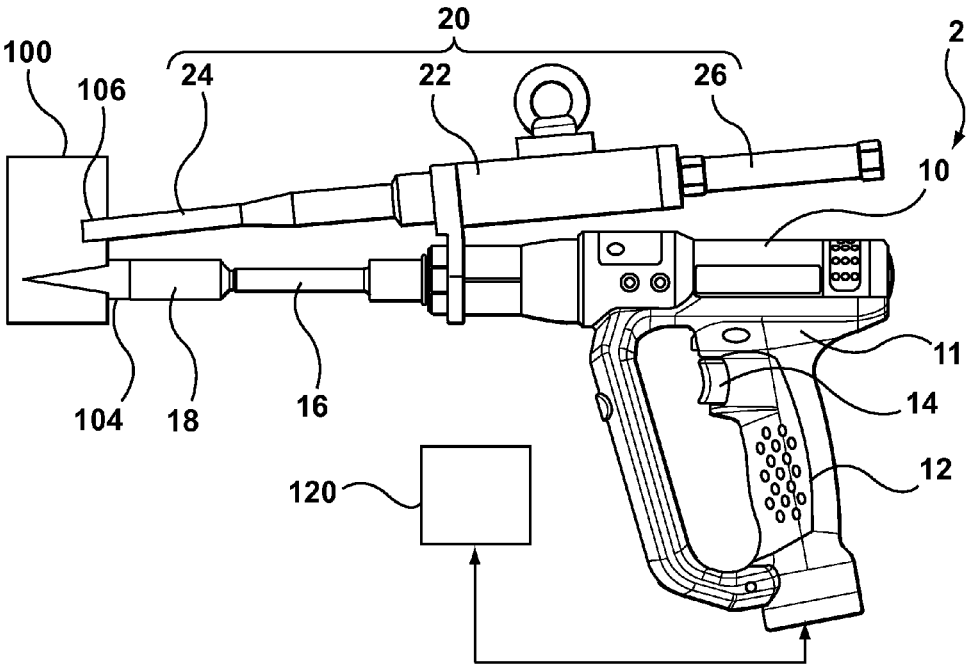

FIGS. 1, 2 and 3 are side views that depict the schematic examples of the representations of the apparatus 2. Generally speaking, the apparatus 2 includes (but is not limited to) a powered tool 10 configured to fasten a fastener to an assembly 100 (also called a work piece). An example of the assembly 100 includes a vehicle-steering column (known and not depicted) of a vehicle (known and not depicted). The powered tool 10 is configured to selectively tighten the fastener of the assembly 100 by applying a fastening force to the fastener. To selectively tighten means to permit the operator or user to initiate or begin tightening of the fastener (application of the fastening force to the fastener is initiated by the user). The powered tool 10 is a semi-automatic tool usable by an operator (human operator). An example of the powered tool 10 includes a pistol grip DC (Direct Current) powered fastener-installation tool. A fastener is a hardware device that mechanically joins or affixes two or more objects together.

Generally speaking, the powered tool 10 includes (but is not limited to) a fastener-driving assembly 18, and a fastener-engagement assembly 20. The fastener-driving assembly 18 is configured to operatively engage the fastener. The fastener-driving assembly 18 is also configured to selectively transmit a fastening force to the fastener. To selectively transmit means that the fastener-driving assembly 18 waits on standby for a signal indicating to begin application of the fastening force to the fastener, such as the user pressing a trigger button for example. The fastener-engagement assembly 20 is configured to permit operative engageable access between the fastener-driving assembly 18 and the fastener. Engageable means able to be engaged. The meaning of "operative engageable access" is that the fastener-driving assembly 18 and the fastener are engageable with each other so as to permit effective transmission of the fastening force from the fastener-driving assembly 18 to the fastener.

FIG. 1 depicts the case where the fastener-engagement assembly 20 is placed in a disabled operation mode, so that the fastener-driving assembly 18 is permitted to have unrestricted operative engageable access to a second fastener 114 (access to any fastener), provided (of course) that the second fastener 114 is configured to engage with the fastener-driving assembly 18. The fastener-engagement assembly 20 and the fastener-driving assembly 18 are depicted set apart from each other, in a side-by-side arrangement one above the other. FIGS. 2 and 3 depict the fastener-engagement assembly 20 placed in an enabled operation mode. It will be appreciated that in accordance with a variation (if so desired), the fastener-engagement assembly 20 may be placed in the disabled operation mode, in which the fastener-driving assembly 18 is not permitted to have unrestricted operative engageable access to a second fastener 114.

FIG. 2 depicts the case where the fastener-engagement assembly 20 is placed in the enabled operation mode. The fastener-engagement assembly 20 is configured to mate with a mating feature that is not depicted in FIG. 2 but is depicted in FIG. 3. As depicted in FIG. 2, the fastener-engagement assembly 20 is configured to deny operative engageable access between the fastener-driving assembly 18 and the second fastener 114 in response to the fastener-engagement assembly 20 not mating with the mating feature. The assembly 100 as depicted in FIG. 2 does not have or provide a mating feature located proximate to the second fastener 114. In effect, since there is no mating feature for the fastener-engagement assembly 20, the fastener-driving assembly 18 is locked out or denied access to the second fastener 114. Access to second fastener 114 is restricted or is blocked (prevented) so that there is un-operative engagement between fastener-driving assembly 18 and the second fastener 114. It is understood that for FIG. 2. the second fastener 114 is prevented from receiving the fastening force from the fastener-engagement assembly 20.

FIG. 3 depicts the case where the fastener-engagement assembly 20 is placed in the enabled operation mode. FIG. 3 also depicts the fastener-engagement assembly 20 configured to mate with a mating feature 106. The fastener-engagement assembly 20 is configured to permit operative engageable access between the fastener-driving assembly 18 and the first fastener 104 in response to the fastener-engagement assembly 20 mating with the mating feature 106. As depicted in the example of FIG. 3, the mating feature 106 is implemented as a recess (a groove, a hole) defined by the assembly 100. That is, the mating feature 106 is positioned on (in) the assembly 100 proximate to or adjacent to the first fastener 104. The assembly 100 (as depicted, in FIG. 3) has the mating feature 106 located proximate to the second fastener 114. The fastener-engagement assembly 20 and the fastener-driving assembly 18 are depicted set apart from each other (and located proximate to each other for the sake of convenience).

In accordance with a variation (not depicted), the mating feature 106 may be positioned on the first fastener 104 if so desired and/or warranted for a desired implementation. For the case where the mating feature 106 is positioned on the first fastener 104, the fastener-engagement assembly 20 and the fastener-driving assembly 18 may be positioned coaxially relative to each other in order to facilitate positing of the mating feature 106 on (or in) the first fastener 104.

In accordance with another option (not depicted), the fastener-engagement assembly 20 includes (several) instances of the rod assembly 24, in which each instance of the rod assembly 24 has or includes a unique shape (profile) configured to mate with a corresponding mating feature. Each instance of the rod assembly 24 may be configured to move (be enabled to move) in response to actuation of a corresponding actuator connected with the instance of the rod assembly 24. In this way, two or more different sets or types of fasteners may be uniquely accessed by the fastener-driving assembly 18, as selectively required. For example, for the case where some fasteners are expected to receive a first amount of fastening force, a first mating feature may be assigned to those fasteners that are expected to receive the first amount of fastening force. For the case where other fasteners are expected to receive a second amount of fastening force, a second mating feature may be assigned to those fasteners that are expected to receive the second amount of fastening force (and so on). The corresponding mating features (and their associated instance of the rod assembly 24) may be positioned set apart (offset) relative to each other. In accordance with an alternative example (not depicted), the mating features (and their corresponding instance of the rod assembly 24) may be positioned coaxially relative to each other, if so desired.

Generally speaking, the fastener-engagement assembly 20 is further configured to move between: (A) a first operation position (as depicted in FIG. 2), and (B) a second operation position (as depicted in FIG. 1).

Referring now to FIG. 1, the second operation position is located in a position behind the fastener-driving assembly 18, and in a location that is not between the assembly 100 and the fastener-driving assembly 18, and in this way the fastener-driving assembly 18 is not blocked or not restricted from accessing the second fastener 114 (thereby permitting operative engagement between the fastener-driving assembly 18 and the second fastener 114). In the second operation position (as depicted in FIG. 1), the fastener-engagement assembly 20 enables unrestricted operative engagement between the fastener-driving assembly 18 and the second fastener 114, so that fastener-driving assembly 18 is able to transmit the fastening force to the second fastener 114. More specifically, in the second operation position, the fastener-engagement assembly 20 is retracted behind the fastener-driving assembly 18. For this case, the fastener-engagement assembly 20 does not abut against the assembly 100 in response to the operator (user) attempting to move the powered tool 10 so as to try to engage the fastener-driving assembly 18 with the second fastener 114.

Referring now to FIG. 2, the first operation position is located ahead of (in front of) the fastener-driving assembly 18, and since the fastener-engagement assembly 20 does not have a corresponding mating feature to mate with, the fastener-driving assembly 18 is prevented (access is blocked or restricted) from operative engagement with the second fastener 114 (thereby preventing operative engagement between the fastener-driving assembly 18 and the second fastener 114). In the first operation position, the fastener-engagement assembly 20 is configured to disable (prevent, impede) operative engagement between the fastener-driving assembly 18 and the second fastener 114, so that fastener-driving assembly 18 is not able to transmit the fastening force to the second fastener 114. More specifically, in the first operation position, the fastener-engagement assembly 20 is protracted ahead of the fastener-driving assembly 18. For this case, the fastener-engagement assembly 20 abuts the assembly 100 in response to the operator (user) attempting to move the powered tool 10 so as to try to engage the fastener-driving assembly 18 with the second fastener 114.

Referring now to FIG. 3, the first operation position is located ahead of (in front of) the fastener-driving assembly 18, and since the fastener-engagement assembly 20 does have the mating feature 106 to mate with, the fastener-driving assembly 18 has operative engagement (access is not blocked or not restricted) with the second fastener 114 (thereby permitting operative engagement between the fastener-driving assembly 18 and the first fastener 104).

Referring to FIGS. 1, 2 and 3 (according to specific implementation details), the fastener-driving assembly 18 further includes (and is not limited to): a rotary shaft 16 that extends (axially and rearward) from the fastener-driving assembly 18. The fastener-driving assembly 18 is rotatably fixed to the rotary shaft 16. A housing assembly 11 is configured to support a motor assembly (known and not depicted). The motor assembly is connectable to the rotary shaft 16. The motor assembly is configured to generate and to apply the fastening force to the rotary shaft 16, so that in turn the rotary shaft 16 transmits the fastening force to the fastener-driving assembly 18, which then transmits the fastening force to a fastener. As well, the fastener-driving assembly 18 further includes a handgrip assembly 12 extending (downwardly) from the housing assembly 11. The handgrip assembly 12 is configured to facilitate user manipulation of the housing assembly 11. A trigger assembly 14 is supported by the housing assembly 11. The trigger assembly 14 is located proximate to the handgrip assembly 12. The trigger assembly 14 is configured to facilitate user initiation of the application of the fastening force by the motor assembly, so that the fastener-driving assembly 18 may drive the fastener into a threaded hole defined by the assembly 100.

The fastener-engagement assembly 20 is attached to a top side of the powered tool 10. According to a specific example, the fastener-engagement assembly 20 includes a frame assembly 22 extending (upwardly) from the powered tool 10. A rod assembly 24 is supported by (and extends from) the frame assembly 22. The rod assembly 24 is movable between the first position (depicted in FIG. 2) and the second position (depicted in FIG. 1). A rod actuator 26 is operatively coupled to the rod assembly 24 (and supported by the frame assembly 22). The rod actuator 26 is configured to move the rod assembly 24 between the first position and the second position. The rod actuator 26 includes, for example, a pneumatic cylinder activated by a solenoid. The rod actuator 26 is configured to (selectively) actuate extension and retraction of the rod assembly 24. For the case where the rod assembly 24 is extended, the rod assembly 24 extends past the fastener-driving assembly 18. For the case where the rod assembly 24 is retracted, the fastener-driving assembly 18 is positioned (extends) ahead of the tip of the rod assembly 24. Extension of the rod assembly 24 disables (prevents) the fastener-driving assembly 18 from operatively engaging certain fasteners. Protraction of the rod assembly 24 enables the fastener-driving assembly 18 to operatively engage certain fasteners.

Generally speaking, in accordance with an option, the apparatus 2 further includes (and is not limited to): a controller assembly 120 configured to control the powered tool 10 via I/O (input/output) interface of the controller assembly 120. The controller assembly 120 is operatively interfaced with the fastener-driving assembly 18 and/or with the fastener-engagement assembly 20 so as to implement control logic as may be required. For example, the fastener-driving assembly 18 is configured to apply an amount of fastening force in response to receiving a force-control signal from the controller assembly 120. As well, the fastener-engagement assembly 20 is configured to selectively move between the first position and the second position in response to receiving a movement-control signal from the controller assembly 120. An instance of the controller assembly 120 may be implemented using computer-coded instructions (software) or using hardware dedicated circuits or a combination of both.

According to a specific example, the controller assembly 120 is configured to: (A) read a work-piece identifier associated with the assembly 100, and (B) set the amount of fastening force, to be applied by the fastener-driving assembly 18, based on the work-piece identifier. An example of the work-piece identifier includes a vehicle identification number (VIN). As well, the controller assembly 120 is configured to: (A) read the work-piece identifier associated with the assembly 100, and (B) set a position of the fastener-engagement assembly 20 between any one of (i) the first position and (ii) the second position, and the position is set based on the work-piece identifier. Actuation of the rod actuator 26 and the rod assembly 24 may occur by using a scanning assembly (such as a laser scanning device, not depicted and known) configured to scan the VIN associated with the assembly 100 of interest, and the scanning assembly passes the information to the controller assembly 120. The work-piece identifier may be used in conjunction with software stored in the memory assembly of the controller assembly 120 which, in turn, extends or retracts the rod assembly 24 accordingly as required.

FIGS. 4, 5, 6 and 7 depict the example schematic representations of the sequenced manufacturing operation for using the apparatus 2 of FIGS. 1, 2 and 3 for fastening the fastener to the assembly 100.

Figure 4:
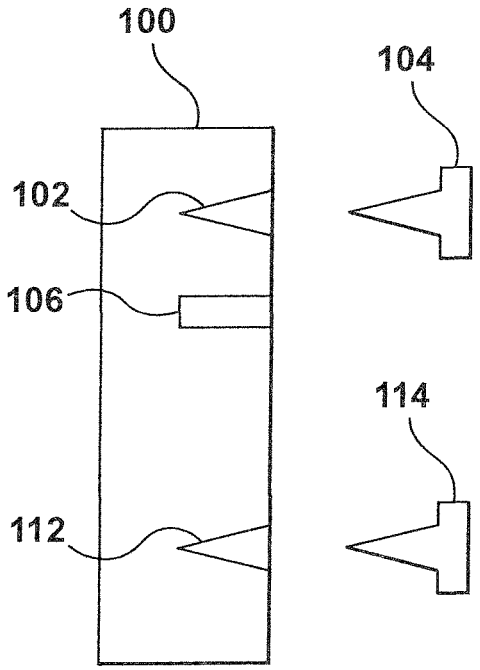
FIGS. 4, 5, 6 and 7 depict exemplary schematic representations of a sequenced manufacturing operation for using the apparatus of FIGS. 1, 2 and 3.

Referring to FIG. 4, the assembly 100 defines a first aperture 102 configured to receive a first fastener 104. The first fastener 104 is to receive a first fastening force (a first given amount of torque) in order to properly connect the first fastener 104 to the assembly 100 via the first aperture 102. The assembly 100 also defines a second aperture 112 configured to receive a second fastener 114. The second fastener 114 is to receive a second fastening force (a second given amount of torque) in order to properly connect the second fastener 114 to the assembly 100 via the second aperture 112. The magnitude of the second fastening force to be applied to (and received by) the second fastener 114 is larger (different) than the magnitude of the first fastening force to be applied to (and received by) the first fastener 104. The assembly 100 also defines a mating feature 106 located proximate to the first aperture 102. The assembly 100 does not define a tool interface located proximate to the second aperture 112.

Figure 5:
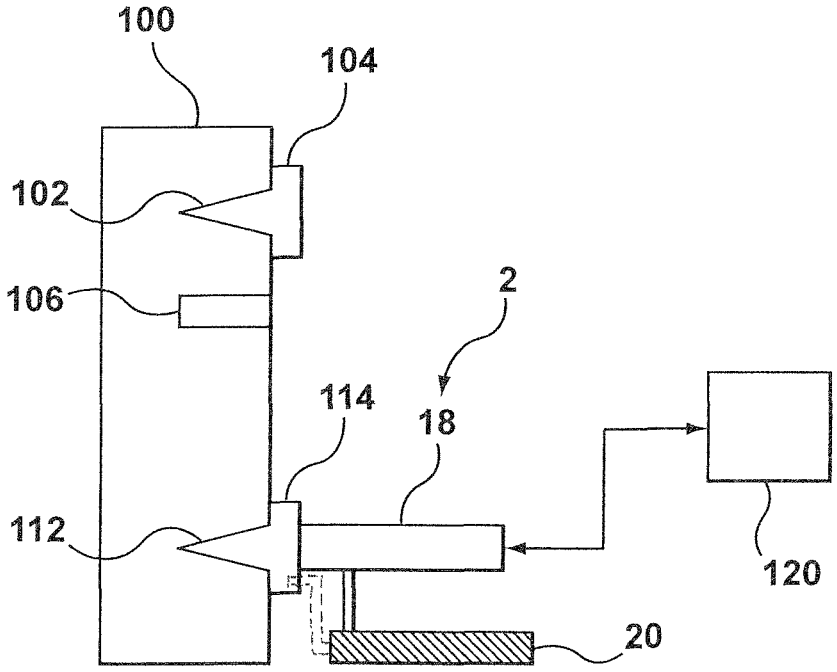

Referring now to FIG. 5, the powered tool 10 includes the fastener-engagement assembly 20 configured to be placed or to be positioned in the first operation position (a protracted position as depicted in FIG. 2 or 3) and in the second operation position (a retracted position as depicted in FIG. 1). FIG. 5 depicts the powered tool 10 placed in the second operation position (retracted position). Generally speaking, in the second operation mode of the powered tool 10, the powered tool 10 is to be used (by the operator) for connecting the second fastener 114 to the assembly 100. More specifically, in the second operation mode, the fastener-engagement assembly 20 of the powered tool 10 is placed in a retracted position extending away from the assembly 100, so that in this manner, the operator has a visual cue that: (A) the powered tool 10 is ready for use with the second fastener 114, and as well (B) the powered tool 10 is not to be used with the first fastener 104. The powered tool 10 makes contact with the second fastener 114 and applies the second fastening force to the second fastener 114 that is received in the second aperture 112 of the assembly 100.

Figure 6:
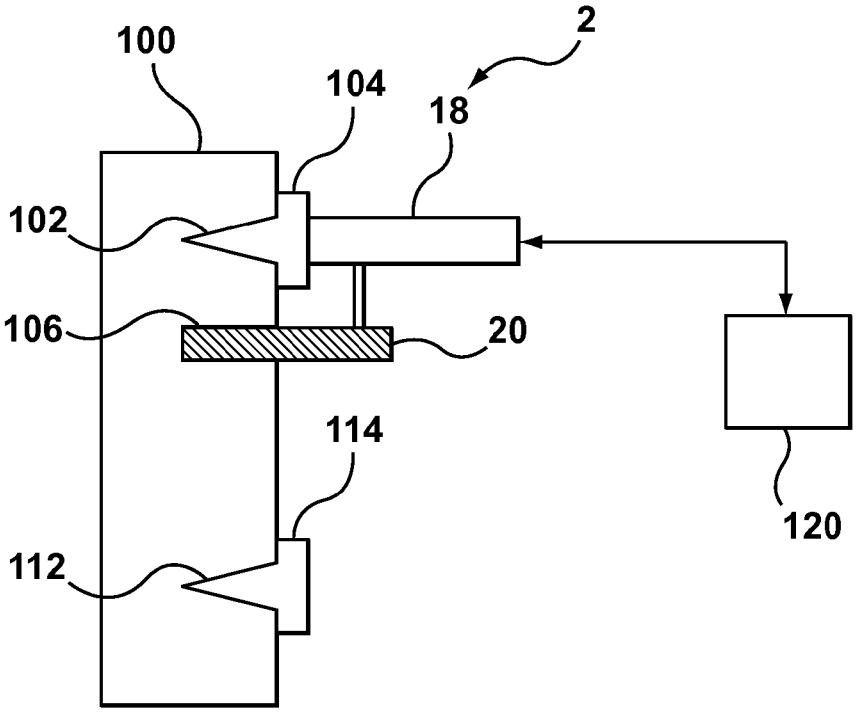

Referring now to FIG. 6, generally speaking, in the first operation mode of the powered tool 10, the powered tool 10 is to be used (by the operator) for connecting the first fastener 104 to the assembly 100. More specifically, in the first operation mode, the fastener-engagement assembly 20 of the powered tool 10 is placed in the protracted position, and the fastener-engagement assembly 20 of the powered tool 10 extends away (outwardly) from the powered tool 10, and the operator positions the fastener-engagement assembly 20 so that the fastener-engagement assembly 20 may interface with the mating feature 106, and the powered tool 10 may connect or may operatively contact with the first fastener 104 thus permitting the powered tool 10 to operatively, when so initiated by the operator, connect the first fastener 104 to the assembly 100. The powered tool 10 makes contact with the first fastener 104 and applies the first fastening force to the first fastener 104 that is received in the first aperture 102 of the assembly 100. More specifically, in the first operating mode, the operator has a visual cue that: (A) the powered tool 10 is ready for use with the first fastener 104, and as well (B) the powered tool 10 is not to be used with the second fastener 114.

However, it will be appreciated that the operator may inadvertently forget to use the powered tool 10 in the correct and expected way (as depicted in FIGS. 4 and 5), and thus may inadvertently apply a potentially undesired fastening force to the first fastener 104.

Referring back to FIG. 6, in the first operating mode, a first potentially incorrect way for the operator to use the powered tool 10 is to use the powered tool 10 to inadvertently apply a force to the second fastener 114 so that the second fastener 114 incorrectly receives the first fastening force. However, since the fastener-engagement assembly 20 extends outwardly (in the first operating mode), the powered tool 10 cannot operatively engage with the second fastener 114, and in this way the second fastener 114 is prevented from receiving the first fastening force from the powered tool 10 because the fastener-engagement assembly 20 blocks or prevents the fastener-driving assembly 18 from operatively engaging the second fastener 114.

Figure 7:
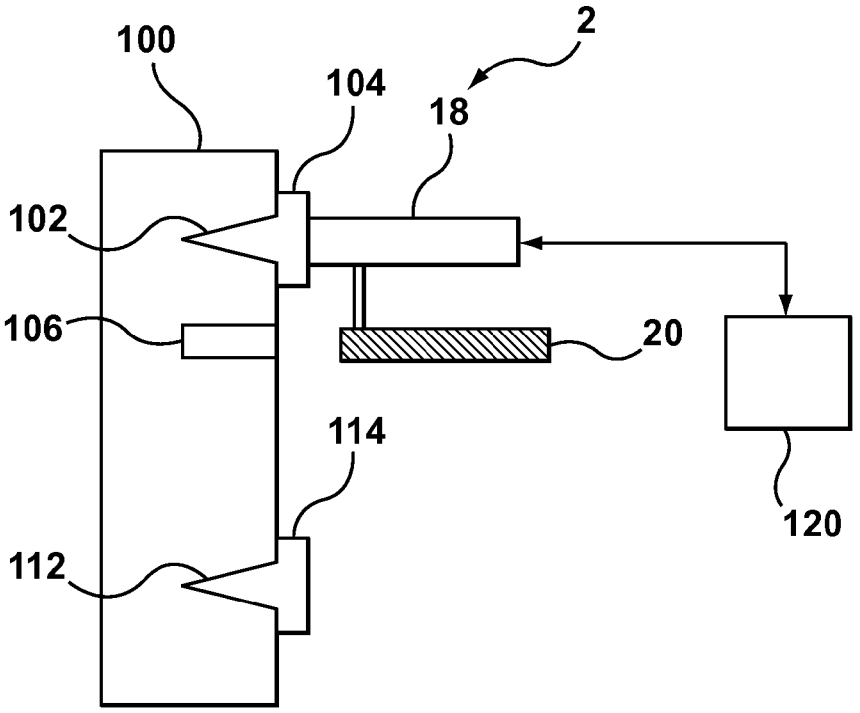

Referring now to FIG. 7, in the second operating mode, a second potentially incorrect way for the operator to use the powered tool 10 is to use the powered tool 10 to inadvertently apply the second fastening force to the first fastener 104, so that the first fastener 104 incorrectly receives the second fastening force from the powered tool 10. In the second operating mode, the fastener-engagement assembly 20 is retracted, and so there is nothing that prevents the operator to execute the second potentially incorrect way for the case as depicted in FIG. 7.

A way to mitigate the misusage or misapplication of the powered tool 10 in the second operating mode (as depicted in FIG. 7) includes the following sequence of operations that may be executed by the controller assembly 120:

An operation (A) includes having the controller assembly 120 read the amount of the second fastening force (torque) from a memory assembly of the controller assembly 120. The amount of the second fastening force is to be applied by the powered tool 10 to the second fastener 114. Once the operation (A) is completed, the next operation (B) may begin.

An operation (B) includes having the controller assembly 120 wait for the operator to apply the second fastening force to the first fastener 104. Once the operation (B) is completed, the next operation (C) may begin.

An operation (C) includes having the controller assembly 120 read (measure) the fastening force (torque) applied by the powered tool 10 to the first fastener 104. Once the operation (C) is completed, the next operation (D) may begin.

An operation (D) includes having the controller assembly 120 compare the measured fastening force to an expected fastening force as retrieved from the memory assembly of the controller assembly 120. Once the operation (D) is completed, the next operation (E) may begin.

An operation (E) includes having the controller assembly 120 provide an indication of whether the measured fastening force and the expected fastening force are not equal (within a given tolerance). Once the operation (E) is completed, the next operation (F) may begin.

An operation (F) includes having the controller assembly 120 proceed with operation in a first operation position for the case where the indication of operation (E) is false (that is the forces are equal). Once the operation (E) is completed, the next operation (F) may begin.

An operation (G) includes having the controller assembly 120 proceed to issue an alarm for the case where the indication of operation (E) is true (that is, the forces are not equal). Once the operation (G) is completed, the next operation (H) may begin.

An operation (H) includes having the controller assembly 120 disable operation of the powered tool 10 for the case where the indication of operation (E) is true (the forces are not equal). Once the operation (H) is completed, the next operation (I) may begin.

An operation (I) includes having the controller assembly 120 wait to receive a reset signal indicating to continue at the operation (A), likely because the error has been corrected going forward (the assembly 100 is reworked, or set aside, etc.).

A way to prevent the second case from occurring is that the operator must pay attention to the fact that the mating feature 106 is not interfaced with (engaged with) the fastener-engagement assembly 20 of the powered tool 10. The fastener-engagement assembly 20 is available or is present for the benefit of the operator of the powered tool 10, so that the operator knows that the first fastener 104 is connected to the powered tool 10 in order that the powered tool 10 may provide the first fastening force to the first fastener 104. As will be appreciated, for the case where the fastener-engagement assembly 20 does not interface with the mating feature 106, the fastener-engagement assembly 20 may inadvertently apply the incorrect fastening force to the first fastener 104 (as depicted in FIG. 7).

In view of the above, for the case where the fastener-engagement assembly 20 is extended: (A) for a first fastener 104 located along a portion of the assembly 100 that includes the mating feature 106 configured for interfacing with (receiving) the fastener-engagement assembly 20, the first fastener 104 may be operatively engaged by the fastener-driving assembly 18, and (B) for a second fastener 114 that does not include mating feature 106 for interfacing with the fastener-engagement assembly 20, the fastener-engagement assembly 20 contacts (abuts) the assembly 100 and thus prevents operative engagement between the fastener-driving assembly 18 and the second fastener 114. In this manner, it may be ensured that only specific and desired fasteners may receive the desired amount of fastening force from the powered tool 10.

In view of the above description, in general terms, there is provided a method for operating the apparatus 2. The method includes: (A) using a fastener-engagement assembly 20 to permit operative engageable access between a fastener-driving assembly 18 and the fastener, (B) using the fastener-driving assembly 18 to operatively engage the fastener in response to operative engageable access being permitted (by the fastener-engagement assembly 20) between the fastener-driving assembly 18 and the fastener, and (C) using the fastener-driving assembly 18 to transmit the fastening force to the fastener.

The following provides additional (potential) implementation details regarding the controller assembly 120: according to one option, the controller assembly 120 includes controller-executable instructions configured to operate the controller assembly 120 in accordance with the description provided above. The controller assembly 120 may use computer software, or just software, which is a collection of computer programs (controller-executable instructions) and related data that provide the instructions for instructing the controller assembly 120 what to do and how to do it. In other words, software is a conceptual entity that is a set of computer programs, procedures, and associated documentation concerned with the operation of a controller assembly 120, also called a data-processing system. Software refers to one or more computer programs and data held in a storage assembly (a memory module) of the controller assembly 120 for some purposes. In other words, software is a set of programs, procedures, algorithms and its documentation. Program software performs the function of the program it implements, either by directly providing instructions to computer hardware or by serving as input to another piece of software. In computing, an executable file (executable instructions) causes the controller assembly 120 to perform indicated tasks according to encoded instructions, as opposed to a data file that must be parsed by a program to be meaningful. These instructions are machine-code instructions for a physical central processing unit. However, in a more general sense, a file containing instructions (such as bytecode) for a software interpreter may also be considered executable; even a scripting language source file may therefore be considered executable in this sense. While an executable file can be hand-coded in machine language, it is far more usual to develop software as source code in a high-level language understood by humans, or in some cases, an assembly language more complex for humans but more closely associated with machine code instructions. The high-level language is compiled into either an executable machine code file or a non-executable machine-code object file; the equivalent process on assembly language source code is called assembly. Several object files are linked to create the executable. The same source code can be compiled to run under different operating systems, usually with minor operating-system-dependent features inserted in the source code to modify compilation according to the target. Conversion of existing source code for a different platform is called porting. Assembly-language source code and executable programs are not transportable in this way. An executable comprises machine code for a particular processor or family of processors. Machine-code instructions for different processors are completely different and executables are totally incompatible. Some dependence on the particular hardware, such as a particular graphics card may be coded into the executable. It is usual as far as possible to remove such dependencies from executable programs designed to run on a variety of different hardware, instead installing hardware-dependent device drivers on the controller assembly 120, which the program interacts with in a standardized way. Some operating systems designate executable files by filename extension (such as .exe) or noted alongside the file in its metadata (such as by marking an execute permission in Unix-like operating systems). Most also check that the file has a valid executable file format to safeguard against random bit sequences inadvertently being run as instructions. Modern operating systems retain control over the resources of the controller assembly 120, requiring that individual programs make system calls to access privileged resources. Since each operating system family features its own system call architecture, executable files are generally tied to specific operating systems, or families of operating systems. There are many tools available that make executable files made for one operating system work on another one by implementing a similar or compatible application binary interface. When the binary interface of the hardware the executable was compiled for differs from the binary interface on which the executable is run, the program that does this translation is called an emulator. Different files that can execute but do not necessarily conform to a specific hardware binary interface, or instruction set, can be represented either in bytecode for Just-in-time compilation, or in source code for use in a scripting language.

According to another option, the controller assembly 120 includes application-specific integrated circuits configured to operate the powered tool 10 in accordance with the description provided above. It may be appreciated that an alternative to using software (controller-executable instructions) in the controller assembly 120 is to use an application-specific integrated circuit (ASIC), which is an integrated circuit (IC) customized for a particular use, rather than intended for general-purpose use. For example, a chip designed solely to run a cell phone is an ASIC. Some ASICs include entire 32-bit processors, memory blocks including ROM, RAM, EEPROM, Flash and other large building blocks. Such an ASIC is often termed a SoC (system-on-chip). Designers of digital ASICs use a hardware description language (HDL) to describe the functionality of ASICs. Field-programmable gate arrays (FPGA) are used for building a breadboard or prototype from standard parts; programmable logic blocks and programmable interconnects allow the same FPGA to be used in many different applications. For smaller designs and/or lower production volumes, FPGAs may be more cost effective than an ASIC design. A field-programmable gate array (FPGA) is an integrated circuit designed to be configured by the customer or designer after manufacturing—hence field-programmable. The FPGA configuration is generally specified using a hardware description language (HDL), similar to that used for an application-specific integrated circuit (ASIC) (circuit diagrams were previously used to specify the configuration, as they were for ASICs, but this is increasingly rare). FPGAs can be used to implement any logical function that an ASIC could perform. The ability to update the functionality after shipping, partial re-configuration of the portion of the design and the low non-recurring engineering costs relative to an ASIC design offer advantages for many applications. FPGAs contain programmable logic components called logic blocks, and a hierarchy of reconfigurable interconnects that allow the blocks to be wired together—somewhat like many (changeable) logic gates that can be inter-wired in (many) different configurations. Logic blocks can be configured to perform complex combinational functions, or merely simple logic gates like AND and XOR. In most FPGAs, the logic blocks also include memory elements, which may be simple flip-flops or more complete blocks of memory. In addition to digital functions, some FPGAs have analog features. The most common analog feature is programmable slew rate and drive strength on each output pin, allowing the engineer to set slow rates on lightly loaded pins that would otherwise ring unacceptably, and to set stronger, faster rates on heavily loaded pins on high-speed channels that would otherwise run too slow. Another relatively common analog feature is differential comparators on input pins designed to be connected to differential signaling channels. A few "mixed signal FPGAs" have integrated peripheral Analog-to-Digital Converters (ADCs) and Digital-to-Analog Converters (DACs) with analog signal conditioning blocks allowing them to operate as a system-on-a-chip. Such devices blur the line between an FPGA, which carries digital ones and zeros on its internal programmable interconnect fabric, and field-programmable analog array (FPAA), which carries analog values on its internal programmable interconnect fabric.

It may be appreciated that the assemblies and modules described above may be connected with each other as may be required to perform desired functions and tasks that are within the scope of persons of skill in the art to make such combinations and permutations without having to describe each and every one of them in explicit terms. There is no particular assembly, components, or software code that is superior to any of the equivalents available to the art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) description provided outside of this document (that is, outside of the instant application as filed, as prosecuted, and/or as granted). It is understood, for the purposes of this document, the phrase "includes (and is not limited to)" is equivalent to the word "comprising." It is noted that the foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a powered tool configured to fasten a fastener to an assembly, the powered tool including:

a fastener-driving assembly configured to operatively selectively engage the fastener, and also configured to selectively transmit a fastening force to the fastener;

a fastener-engagement assembly configured to permit operative engageable access between the fastener-driving assembly and the fastener;

a controller assembly operatively interfaced with the fastener-driving assembly and with the fastener-engagement assembly;

the fastener-driving assembly being configured to apply an amount of fastening force in response to receiving a force-control signal from the controller assembly; and the fastener-engagement assembly being configured to selectively move between a first position and a second position in response to receiving a movement-control signal from the controller assembly.

2. The apparatus of claim 1, wherein:

the fastener-engagement assembly is configured to mate with a mating feature; and the fastener-engagement assembly is configured to permit operative engageable access between the fastener-driving assembly and the fastener in response to the fastener-engagement assembly mating with the mating feature.

3. The apparatus of claim 1, wherein:

the fastener-engagement assembly is configured to mate with a mating feature; and the fastener-engagement assembly is configured to deny operative engageable access between the fastener-driving assembly and the fastener in response to the fastener-engagement assembly not mating with the mating feature.

4. The apparatus of claim 1, wherein:

the fastener-engagement assembly is configured to mate with a mating feature; and the mating feature is positioned on the assembly.

5. The apparatus of claim 1, wherein:

the fastener-engagement assembly is configured to mate with a mating feature; and the mating feature is positioned on the fastener.

6. The apparatus of claim 1, wherein the fastener-engagement assembly includes:

instances of a rod assembly, each instance of the rod assembly having or including a unique shape configured to mate with a corresponding mating feature, and wherein each of the instances of the rod assembly is configured to be enabled in response to actuation of a corresponding actuator connected with the instance of the rod assembly.

7. The apparatus of claim 6, wherein corresponding mating features are implemented set apart relative to each other.

8. The apparatus of claim 1, wherein the fastener-engagement assembly is further configured to move between:

a first operation position located ahead of the fastener-driving assembly, and a second operation position located behind the fastener-driving assembly, and in a location that is not between the assembly and the fastener-driving assembly.

9. The apparatus of claim 1, wherein:

in a first operation position, the fastener-engagement assembly is configured to disable operative engagement between the fastener-driving assembly and the fastener, so that the fastener-driving assembly is not able to transmit the fastening force to the fastener; and in a second operation position, the fastener-engagement assembly enables operative engagement between the fastener-driving assembly and the fastener, so that the fastener-driving assembly is able to transmit the fastening force to the fastener.

10. The apparatus of claim 1, wherein:

in a first operation position, the fastener-engagement assembly is protracted ahead of the fastener-driving assembly, and in a second operation position, the fastener-engagement assembly is retracted behind the fastener-driving assembly.

11. The apparatus of claim 1, wherein the fastener-driving assembly further includes:

a rotary shaft extending from the fastener-driving assembly, the fastener-driving assembly being rotatably fixed to the rotary shaft; and a housing assembly configured to support a motor assembly, the motor assembly being connectable to the rotary shaft, the motor assembly configured to apply the fastening force to the rotary shaft so that, in turn, the rotary shaft transmits the fastening force to the fastener-driving assembly, which then transmits the fastening force to the fastener.

12. The apparatus of claim 11, wherein the fastener-driving assembly further includes:

a handgrip assembly extending from the housing assembly, the handgrip assembly configured to facilitate user manipulation of the housing assembly; and a trigger assembly supported by the housing assembly, the trigger assembly located proximate to the handgrip assembly and configured to facilitate initiation of application of the fastening force by the motor assembly, so that the fastener-driving assembly may drive the fastener into a threaded hole defined by the assembly.

13. The apparatus of claim 1, wherein the fastener-engagement assembly includes:

a frame assembly extending from the powered tool;

a rod assembly supported by the frame assembly, the rod assembly being movable between a first position and a second position; and a rod actuator operatively coupled to the rod assembly, the rod actuator configured to move the rod assembly between the first position and the second position.

14. The apparatus of claim 1, wherein the controller assembly is configured to:

read a work-piece identifier associated with the assembly; and set the amount of fastening force to be applied by the fastener-driving assembly, based on the work-piece identifier.

15. The apparatus of claim 1, wherein the controller assembly is configured to:

read a work-piece identifier associated with the assembly; and set a position of the fastener-engagement assembly between any one of the first position and the second position based on the work-piece identifier.

16. The apparatus of claim 1, wherein the controller assembly is configured to:

read an amount of a second fastening force from a memory assembly, the amount of the second fastening force to be applied by the powered tool to a second fastener;

wait for an operator to apply the second fastening force to a first fastener;

read the fastening force applied by the powered tool to the first fastener;

compare a measured fastening force to an expected fastening force as retrieved from the memory assembly of the controller assembly; and provide an indication of whether the measured fastening force and the expected fastening force are not equal.

17. The apparatus of claim 1, wherein the controller assembly is further configured to issue an alarm for a case where the indication is true.

18. The apparatus of claim 1, wherein the controller assembly is further configured to disable operation of the powered tool for a case where the indication is true.

19. A method of using an apparatus including a powered tool configured to fasten a fastener to an assembly, the method comprising:

enabling a fastener-engagement assembly to permit operative engageable access between a fastener-driving assembly and the fastener;

in response to operative engageable access being permitted by the fastener-engagement assembly, enabling a controller assembly operatively interfaced with the fastener-driving assembly and with the fastener-engagement assembly;

enabling the fastener-driving assembly to apply an amount of fastening force in response to receiving a force-control signal from the controller assembly;

enabling the fastener-engagement assembly to selectively move between a first position and a second position in response to receiving a movement-control signal from the controller assembly; and using the fastener-driving assembly to transmit a fastening force to the fastener.

* * * * *